US007303026B2

(12) United States Patent
Frauhammer et al.

(10) Patent No.: US 7,303,026 B2
(45) Date of Patent: Dec. 4, 2007

(54) HAND POWER TOOL, IN PARTICULAR DRILL HAMMER AND/OR JACKHAMMER

(75) Inventors: Karl Frauhammer, Leinfelden-Echterdingen (DE); Heinz Schnerring, Dettenhausen (DE); Willy Braun, Neustetten (DE); Axel Kuhnle, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 113 days.

(21) Appl. No.: 11/135,187

(22) Filed: May 23, 2005

(65) Prior Publication Data

US 2005/0263306 A1 Dec. 1, 2005

(30) Foreign Application Priority Data

May 27, 2004 (DE) ..... 10 2004 025 951

(51) Int. Cl.
*B25D 11/00* (2006.01)

(52) U.S. Cl. ..... 173/48; 173/201

(58) Field of Classification Search ..... 173/201, 173/109, 216, 178, 48, 217
See application file for complete search history.

(56) References Cited

U.S. PATENT DOCUMENTS 3,269,466 A * 8/1966 Mitchell ..... 173/93.6
3,874,460 A * 4/1975 Schmid et al. ..... 173/109
4,236,588 A * 12/1980 Moldan et al. ..... 173/48
4,446,931 A * 5/1984 Bleicher et al. ..... 173/48
4,776,406 A 10/1988 Wanner
5,201,373 A 4/1993 Bloechle
5,588,496 A 12/1996 Elger
5,842,527 A * 12/1998 Arakawa et al. ..... 173/48
6,176,321 B1 1/2001 Arakawa
6,196,330 B1 * 3/2001 Matthias et al. ..... 173/48
6,478,095 B2 * 11/2002 Neumaier ..... 173/48
6,510,903 B2 * 1/2003 Funfer ..... 173/48
6,557,648 B2 * 5/2003 Ichijyou et al. ..... 173/48
6,644,418 B2 * 11/2003 Haga ..... 173/48

(Continued)

FOREIGN PATENT DOCUMENTS

DE 3731244 3/1989

(Continued)

*Primary Examiner*—Scott A. Smith
(74) *Attorney, Agent, or Firm*—Michael J. Striker

(57) ABSTRACT

A hand power tool has a housing, and drive motor accommodated in the housing, a tool receptacle in which a tool is guided, a gear mechanism, a driving gear, and rotary sleeve arranged so that via the gear mechanism, the driving gear, and the rotary sleeve the tool receptacle is drivable in rotation, a crank drive mechanism and a hammering mechanism located inside the rotary sleeve so that the tool receptacle is drivable through the crank drive mechanism and the hammering mechanism translationally, and a safety coupling provided between the driving gear wheel and the rotary sleeve and formed so that the safety coupling separates if a limit torque is exceeded, the safety coupling being formed as an overlock coupling seated on the rotary sleeve and having two axially adjacent coupling parts that mesh in a form-locked manner by torque-transmitting transmission elements and are overlockable if the limit torque is exceeded counter to an axially acting elastic force, one of the coupling parts being a part associated with the driving gear wheel and rotatable relative to the rotary sleeve while the other of the coupling parts is coupled to the rotary sleeve in a way that transmits torque.

9 Claims, 6 Drawing Sheets

U.S. PATENT DOCUMENTS

| | | | | |
|---|---|---|---|---|
| 6,675,908 | B1 * | 1/2004 | Frauhammer et al. | 173/48 |
| 6,810,969 | B2 * | 11/2004 | Meixner | 173/201 |
| 2003/0146007 | A1 | 8/2003 | Greitmann | |

FOREIGN PATENT DOCUMENTS

| | | |
|---|---|---|
| DE | 3804414 | 8/1989 |
| EP | 0224010 | 6/1987 |
| EP | 1334805 | 8/2003 |
| GB | 2394516 | 4/2004 |

* cited by examiner

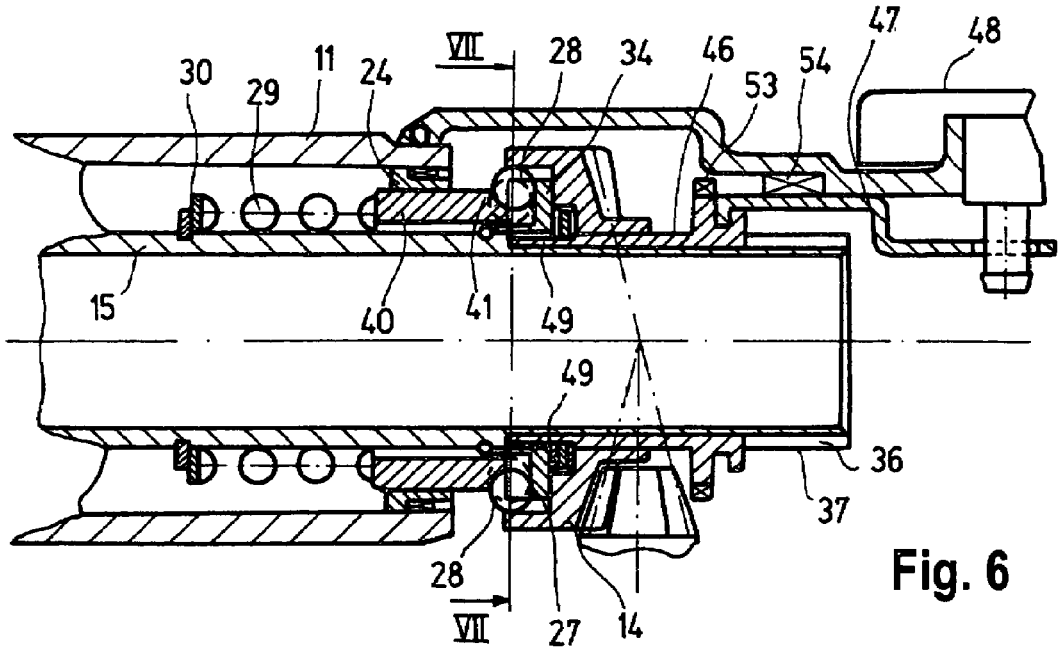
Fig. 6
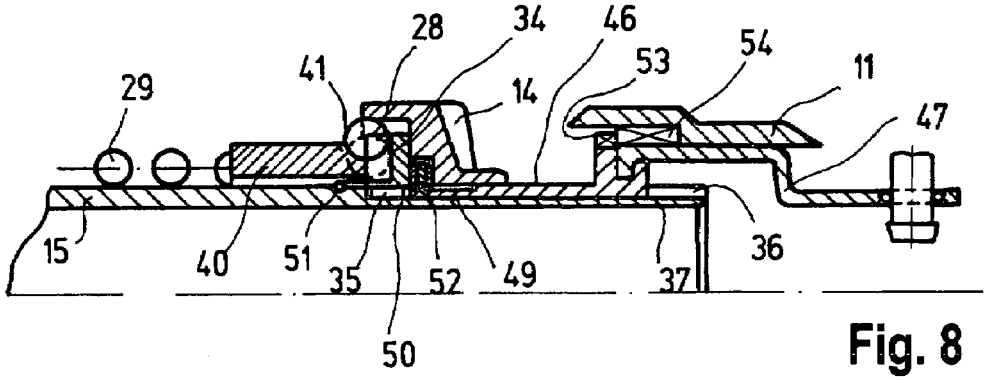
Fig. 8
Fig. 9
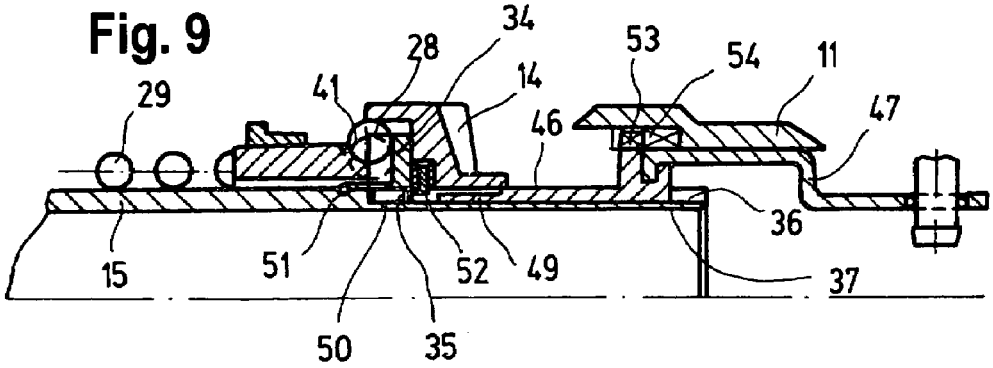

HAND POWER TOOL, IN PARTICULAR DRILL HAMMER AND/OR JACKHAMMER

CROSS-REFERENCE

The invention described and claimed hereinbelow is also described in DE 102004025951.8, filed on May 27, 2004. This German Patent Application, whose subject matter is incorporated here by reference, provides the basis for a claim of priority of invention under 35 U.S.C. 119 (a)-(d).

BACKGROUND OF THE INVENTION

The invention is based on a hand power tool, in particular a drill hammer and/or jackhammer.

Known hand power tools of this kind are provided by the safety coupling, which is intended to protect the operator against an excessively great reaction torque if the tool being driven stops suddenly, for instance if a drilling tool seizes. In a known hand power tool, a safety coupling of this kind is provided in the region of the rotary sleeve, which is adjacent to the tool receptacle. The rotary sleeve is designed in two parts. On the end toward the drive mechanism, the sleeve part that receives the hammering mechanism receives a coupling sleeve inserted into it on the power takeoff end. The drive moment is transmitted by means of a plurality of transmission elements, in the form of balls, located in through bores of the rotary sleeve part. They are retained radially inward in approximately V-shaped ball pockets of the coupling sleeve and are retained outward by a spring-loaded wedge-shaped support ring. If a predetermined limit torque is exceeded, the transmission elements are forced radially out of the V-shaped ball pockets of the coupling sleeve, so that with the coupling sleeve blocked, the rotary sleeve part that receives it and is still being driven as before can continue to revolve, and a relative motion between the two is possible. The spring-loaded support ring makes the axial compensatory motion possible. This two-part design is comparatively expensive, since both the rotary sleeve part and the coupling sleeve have to be ground on both the outside and the inside. Since the tool receptacle must be accommodated near the striking pin of the hammering mechanism, and the smaller-diameter coupling sleeve, problems arise in terms of bracing, sealing and damping in the region of the striking pin of the hammering mechanism. Moreover, the play that exists between the coupling sleeve and the rotary sleeve impairs the concentricity of a tool fastened in place when it is driven to rotate.

SUMMARY OF THE INVENTION

Accordingly, it is an object of the present invention to provide a hand power tool, in particular a drill hammer and/or a jack hammer, which eliminates the disadvantages of the prior art.

In keeping with these objects and with others which will become apparent hereinafter, one feature of the present invention resides, briefly stated, in a hand power tool, comprising a housing; and drive motor accommodated in said housing; a tool receptacle in which a tool is guided; a gear mechanism, a driving gear, and rotary sleeve arranged so that via said gear mechanism, said driving gear, and said rotary sleeve said tool receptacle is drivable in rotation; a crank drive mechanism and a hammering mechanism located inside said rotary sleeve so that said tool receptacle is drivable through said crank drive mechanism and said hammering mechanism transnationally; and a safety coupling provided between said driving gear wheel and said rotary sleeve and formed so that said safety coupling separates if a limit torque is exceeded, said safety coupling being formed as an overlooked coupling seated on said rotary sleeve and having two axially adjacent coupling parts that mesh in a form-locked manner by torque-transmitting transmission elements and are overlockable if the limit torque is exceeded counter to an axially acting elastic force, one of said coupling parts being a part associated with said driving gear wheel and rotatable relative to said rotary sleeve while the other of said coupling parts is coupled to said rotary sleeve in a way that transmits torque.

The safety coupling can be integrated in the region of the driving gear wheel, and depending on the design, the prerequisites for enabling the integration of the safety coupling with a switching device of the hand power tool are also created. By means of this device, various operating functions of the hand power tool are adjustable.

The rotary sleeve may be designed as a one-piece component, which compared to known hand power tools can also be made markedly shorter. The result is a more-economical version with only one component, instead of the known two-part design. Any play between two components thus is dispensed with. Because the rotary sleeve is in one piece, it offers more installation space in the region of the striking pin of the hammering mechanism. A favorable extruded striking pin, which is less expensive, can therefore be employed. Moreover, advantageous bracing and sealing of the striking pin of the hammering mechanism are possible. It is also advantageous that the idling control of the hand power tool can be implemented by means of a favorable, time-tested O-ring impact-absorbing device. Moreover, the possibility exists of using favorable sintered components or precision-stamped components with multiple functions as detent elements. Bundling functions and reducing the number of components make it possible overall to achieve a great saving in terms of expenses and installation space while attaining high quality.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a schematic axial longitudinal section of a detail of the hand power tool, in a third exemplary embodiment, in a working position;

FIGS. 8 and 9 each show a schematic axial longitudinal section of the detail in FIG. 6, in a vario-lock and chiseling position, respectively;

DESCRIPTION OF THE PREFERRED EMBODIMENTS

Figure 1:
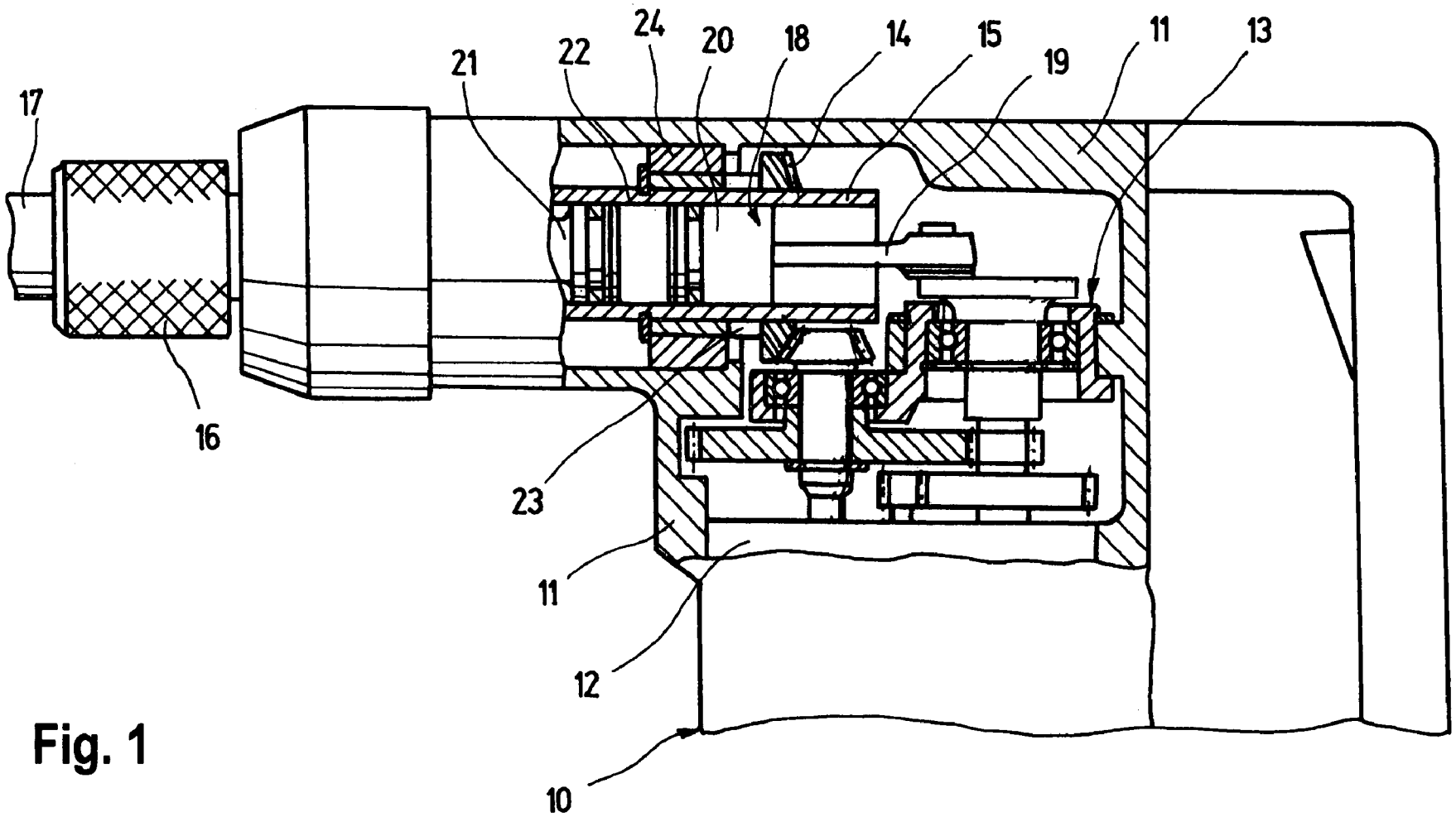
FIG. 1 is a schematic side view, partly in section, of a hand power tool.

First, in conjunction with FIG. 1, the construction of a hand power tool 10, embodied in particular as a drill hammer and/or jackhammer, will be described briefly. The hand power tool 10 has a housing 11, which includes a drive motor 12, in particular electric, which works via a gear mechanism 13 on a drilling and/or hammering mechanism that follows it. To that end, the gear mechanism 13 is in engagement with a driving gear wheel 14, which is coupled for driving to a rotary sleeve 15. The driving gear wheel 14 preferably comprises a cone wheel. By means of the drive motor 12 and the gear mechanism 13, via the driving gear wheel 14, the rotary sleeve 15 and means of it a tool receptacle 16, in which a tool 17 can be guided, are drivable in rotation. Via the drive motor 12 and the gear mechanism 13, a hammering mechanism 18 can also be driven translationally by means of a preceding crank drive mechanism 19.

The hammering mechanism 18, inside the rotary sleeve 15, has a piston 20, driven to reciprocate by the crank drive mechanism 19, and also has a beater 21 and following the beater, a striking pin; there is an air cushion 22 between the piston 20 and the beater 21. The tool 17 is received in the tool receptacle 16 in such a way that when the rotational drive is effected, it is slaved in the circumferential direction and, upon being driven via the hammering mechanism 18, is movable back and forth in the tool receptacle 16 and is subjected to the percussion energy via the beater 21 by the striking pin following it.

It is indicated only schematically in FIG. 1 that between the driving gear wheel 14 and the rotary sleeve 15 a safety coupling 23 is provided, which if a limit torque is exceeded disconnects the driving connection between the driving gear wheel 14 and the rotary sleeve 15. The safety coupling 23 is located in the region of a rear bearing 24, such as a slide bearing, that is retained in the housing 11. Details of this safety coupling 23 will be provided below in conjunction with FIGS. 2 through 13.

Figure 2:
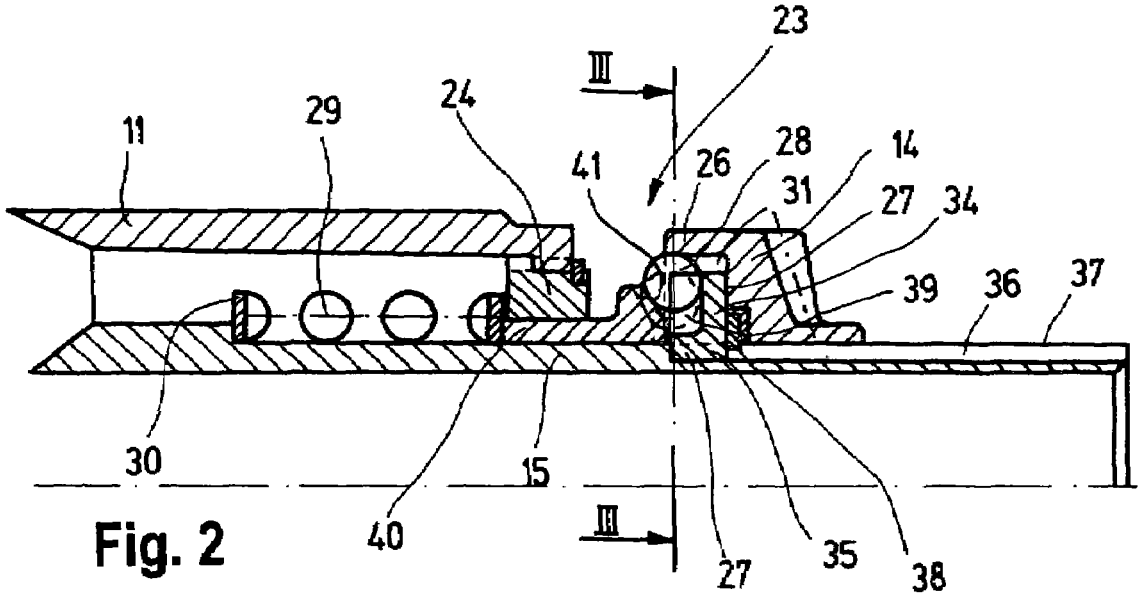
FIG. 2 is a schematic axial longitudinal section of a detail of the hand power tool, in a first exemplary embodiment.
Figure 3:
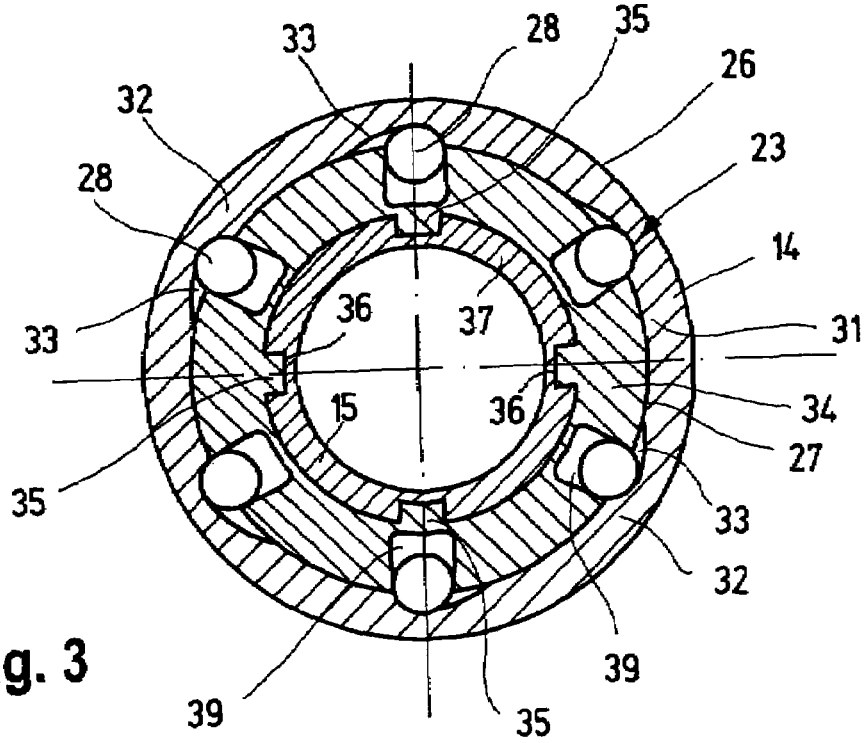
FIG. 3 is a schematic section taken along the line III-III in FIG. 2.

In the first exemplary embodiment in FIGS. 2 and 3, the safety coupling 23 is embodied as an overlock coupling 25, which is seated on the rotary sleeve 15 and has two axially adjacent coupling parts 26 and 27, which mesh in a form-locked manner by means of torque-transmitting transmission elements 28, which here comprise balls, and if the limit torque is exceeded are overlockable counter to an elastic force, exerted axially from the right in terms of FIG. 2, brought to bear by a spring 29. The spring 29 is seated on the rotary sleeve 15, relative to which it is axially braced by one end in the region of a ring 30. The spring 29 is embodied as a cylindrical helical spring, and with its other end it acts axially on the overlock coupling 25.

The one coupling part 26 is a part 31 which is associated with the driving gear wheel 14 and is rotatable relative to the rotary sleeve 15; in the first exemplary embodiment in FIGS. 2 and 3, this part 31 is a component that is integrated with the driving gear wheel 14 and is thus in one piece with it. This coupling part 26 thus designed has a ring 32 that is in one piece with the driving gear wheel 14 and protrudes from it axially to the left in terms of FIG. 2, with radially indented detent pockets 33 on the inside for the transmission elements 28, in particular balls.

The other coupling part 27, in the first exemplary embodiment, is coupled directly in a form-locked manner to the rotary sleeve 15 in such a way as to transmit torque. It is embodied as a ring 34, which is seated on the rotary sleeve 15 and which, with radially inward-oriented protrusions 35, such as lugs, cleats or the like, engages associated longitudinal grooves 36 on a portion 37 of the rotary sleeve 15 in a form-locked manner. With respect to the rotary sleeve 15, the ring 34 is fixed axially nondisplaceably by stopping against the end of the portion 37 and by means of a securing ring 38, which may also serve to fix the driving gear wheel 14 in this axial direction.

The ring 34 has approximately dish-shaped recesses 39 for the transmission elements 28, in particular balls. The recesses 39 are open toward the left-hand axial side, in terms of FIG. 2, and are also open radially outward, so that the transmission elements 28 can also protrude in both the radial direction and the axial direction. The transmission elements 28 can thus the detent pockets 33 in the ring 32 in a form-locked manner and, because they protrude axially, they can be acted upon by the axially acting elastic force by means of the spring 29. To that end, a sleeve 40 is retained axially displaceably on the rotary sleeve 15; it is pressed, with a frustoconical face 41 on its end, axially against the transmission elements 28, in particular balls, by means of the spring 29. With its end toward the sleeve 40, the spring 29 is braced on this sleeve and acts upon the sleeve 40 with the axially acting elastic force. The sleeve 40 is supported relative to the housing 11 by means of the bearing 24, in particular a slide bearing, located there.

This safety coupling 23, shown in FIGS. 2 and 3, of the first exemplary embodiment operates on the radial-axial principle. Since this does not make any rotary shutoff possible, in a hand power tool equipped with this safety coupling 23, no purely chiseling mode of operation is possible.

In operation, the driving gear wheel 14 is driven to revolve by means of the drive motor 12 via the gear mechanism 13, and the rotary motion is transmitted to the transmission elements 28, in particular balls, via the detent pockets 33. Since the detent pockets are supported in the recesses 39 of the second coupling part 27 in the form of the ring 34 in a form-locked manner, the second coupling part 27 in the form of the ring 34 is slaved by them in the direction of rotation. Because of the protrusions 35 of the ring 34 that engage the longitudinal grooves 36, the rotary motion is transmitted to the rotary sleeve 15 by them. Retention and prestressing of the transmission elements 28 is provided by the sleeve 40 with the frustoconical face 41, which is located movably between the bearing 24 and the rotary sleeve 15 and is axially acted upon by the spring 29. If the limit torque, set via the spring 29, is exceeded, the transmission elements 28 are pressed out of the detent pockets 33, counter to the prestressing of the sleeve 40, so that the driving gear wheel 14 can continue to rotate relative to the now-stationary ring 34 and to the stationary rotary sleeve 15. As a result of this response of the safety coupling 23, the operator of the hand power tool 10 is protected against an excessively high reaction torque, for instance if the tool 17 suddenly seizes. Moreover, the components of the hand power tool are likewise protected against damage, premature wear, or even destruction.

The safety coupling 23 is simple and inexpensive. It has a long service life and good response precision. With high quality, the number of components can be reduced by bundling the functionalities, and a considerable reduction in expense and also installation space can be attained. The construction is relatively short in length; the rotary sleeve 15 offers radially more installation space in the region of the striking pin, which is not visible, of the hammering mechanism 18, making it possible to use a favorable striking pin, such as an extruded striking pin. In addition, advantageous bracing and sealing of the striking pin of the hammering mechanism 18 thus become possible. It is also advantageous that the idling control of the hand power tool 10 can be represented by a favorable, time-tested O-ring impact-absorbing device. It is moreover advantageous that by means of the safety coupling 23, the possibility is afforded of embodying individual components of the safety coupling 23 as sintered parts or precision-stamped components, advantageously with multiple functions. Overall, the safety coupling 23 makes a lighter-weight, more-compact design of the hand power tool 10 possible, with the attendant improved concentricity for the tool 17 to be driven, which makes more-exact starting of drilling possible.

Figure 4:
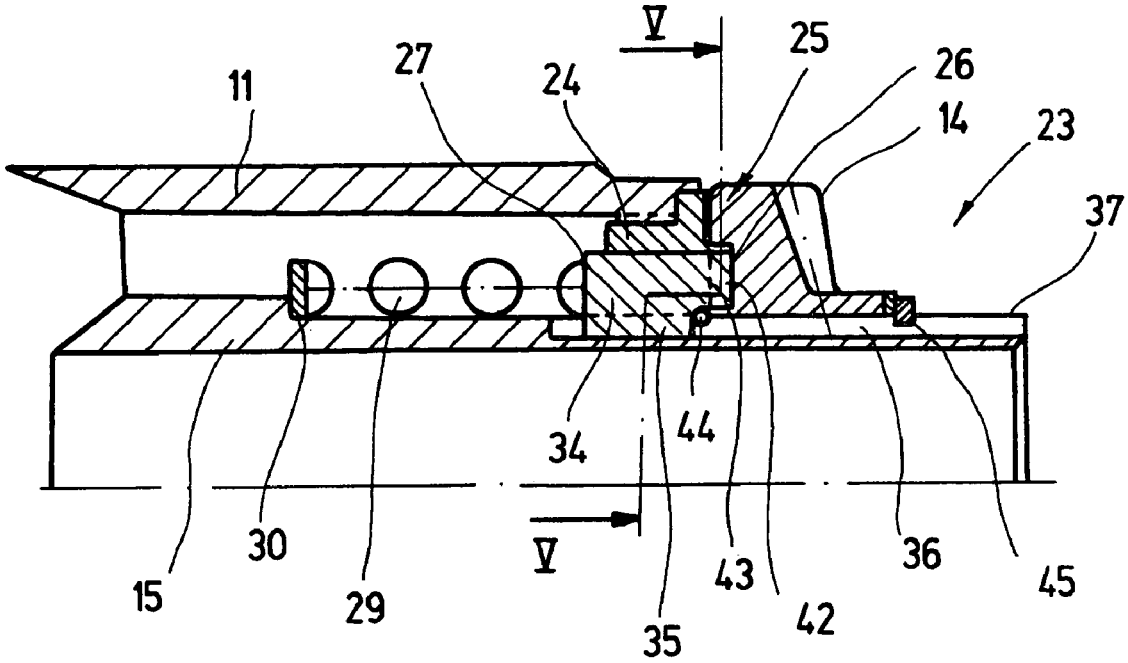
FIG. 4 is a schematic axial longitudinal section of a detail of the hand power tool, in a second exemplary embodiment.
Figure 5:
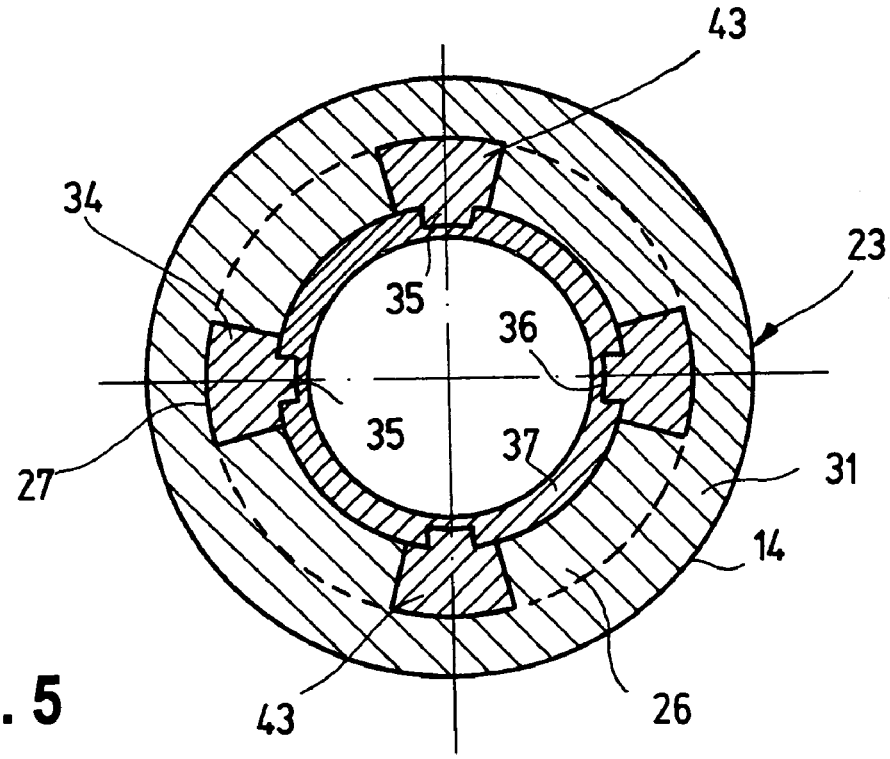
FIG. 5 is a schematic section taken along the line V-V in FIG. 4.

In the second exemplary embodiment, shown in FIGS. 4 and 5, the same reference numerals are used for parts equivalent to those in the first exemplary embodiment, so that to avoid repetition, the description of the first exemplary embodiment is referred to. In this second exemplary embodiment, the safety coupling 23 is again embodied as an overlock coupling 25, which is adjacent to that end of the rotary sleeve 15 on which as in FIG. 1 the crank drive mechanism 19 for the hammering mechanism 18 is located. Also in this overlock coupling 25, the one coupling part 26 is a component that is integrated with the driving gear wheel 14 and is thus specifically in one piece with it. This one coupling part 26, on an axial face end, has axial, toothlike coupling claws 42, which may be designed approximately helically as viewed in the drive direction of the driving gear wheel 14, to enable engagement with as little wear as possible and a correspondingly low-wear overlooking.

The other coupling part 27 is embodied as a ring 34, which is seated on the rotary sleeve 15 and, with radially inward-oriented protrusions 35, such as lugs, cleats or the like, engages the associated longitudinal grooves 36 of the portion 37 of the rotary sleeve 15 in a form-locked manner. On the axial face end oriented toward the coupling part 26 and its coupling claws 42, the ring 34 has axial toothlike coupling claws 43, corresponding to the coupling claws 42 and thus meshing with them. The ring 34 is acted upon in an axial direction by the elastic force generated by the spring 29 and is retained axially displaceably on the rotary sleeve 15; the displacement travel is limited by a securing ring 44. The ring 34 is supported in the housing 11 by means of the bearing 24. The driving gear wheel 14 is fixed axially nondisplaceably on the rotary sleeve 15 on the one hand by stopping against the bearing 24 and on the other by means of a securing ring 45.

The second coupling part 27 in the form of the ring 34 is pressed by means of the spring 29 axially against the first coupling part 26, in such a way that the coupling claws 43 enter into and remain in engagement with the coupling claws 42 in a form-locked manner. The safety coupling 23 in this second exemplary embodiment functions exclusively axially. The torque transmission between the driven driving gear wheel 14 and the ring 34 is effected via the respective, approximately helical coupling claws 42, 43, which act as a spur gear. Since the ring 34, with its protrusions 35, engages the longitudinal grooves 36 in a form-locked manner, the drive moment is transmitted to the rotary sleeve 15 thereby. The drive moment is maintained by the contact against the spring 29 and the engagement of the coupling claws 42, 43. If the limit torque is exceeded, or in other words when the rotary sleeve 15 is stationary, the driving gear wheel 14 and the ring 34 come unlatched from one another in the region of the coupling claws 42, 43, since the ring 34 is capable of deflecting axially counter to the prestressing of the spring 29.

In the third exemplary embodiment, shown in FIGS. 6 through 9, the construction of the safety coupling 23 is in principle equivalent to that of the first exemplary embodiment in FIGS. 2 and 3, so that in this respect, reference is made to that exemplary embodiment to avoid repetition. There is a distinction, in that the second coupling part 27 is not coupled for transmitting torque directly to the rotary sleeve 15 in a form-locked manner; instead, this is done indirectly, as will be described in detail hereinafter.

A sliding-key sleeve 46 is seated on the rotary sleeve 15 and is axially displaceable by means of an actuating member 47, for instance in the form of a shift rod, which is connected to a knob 48 for manipulation purposes. The sliding-key sleeve 46 has slaving cleats 49, which protrude radially inward and engage the associated longitudinal grooves 36 of the portion 37 of the rotary sleeve 15 in a form-locked manner. The ring 34 that forms the second coupling part 27 in turn has radially inward-oriented protrusions 35, such as lugs, cleats or the like, which in a departure from the first exemplary embodiment engage an encompassing annular groove 50 of the portion 37 of the rotary sleeve 15. The annular groove 50 is adjacent to the longitudinal grooves 36 and has an axial width that is only slightly greater than that of the protrusions 35. The ring 34 is axially nondisplaceable relative to the rotary sleeve 15 and is fixed for instance by means of securing rings 51, 52. The ring 34 is thus freely rotatable relative to the rotary sleeve 15, and its protrusions 35 can revolve freely in the annular groove 50.

Depending on the axial displacement position of the sliding-key sleeve 46, its slaving cleats 49 engage more or less far axially over the region of the annular groove 50. In the operating position shown in FIG. 6, which corresponds to the hammer drilling function, the slaving cleats 49 engage crosswise all the way across the annular groove 50. In the displacement position shown in FIG. 8, the annular groove 50 is entirely uncovered by the slaving cleats 49. This position is equivalent to the vario-lock mode of operation, in which the rotary sleeve 15 is not driven and is freely rotatable, for instance for purposes of adjustment for a desired chiseling mode of operation. In the position of the sliding-key sleeve 46 displaced still farther to the right, shown in FIG. 9, the hand power tool is in the chiseling function, in which the rotary sleeve 15 is fixed to be nonrotatable.

The sliding-key sleeve 46 has an outer, axially oriented spline shaft toothing 53, which is axially aligned with an inner spline shaft toothing 54 on the housing. In the displacement position shown in FIG. 9, the sliding-key sleeve 46, with the spline shaft toothing 53, meshes in a form-locked manner with the spline shaft toothing 54 of the housing, so that the sliding-key sleeve 46 is nonrotatable. Since its slaving cleats 49 the longitudinal grooves 36 of the rotary sleeve 15 in a form-locked manner, the rotary sleeve 15 is thereby blocked against rotation. If the driving gear wheel 14 continues to be driven as before, it revolves and, via the transmission elements 28, carries the second coupling part 27 in the form of the ring 34 along with it, which can therefore revolve freely, since its protrusions 35 can revolve unhindered in the annular groove 50. It is thus attained that the transmission elements 28, in particular balls, can roll in frictionless fashion as much as possible.

Figure 7:
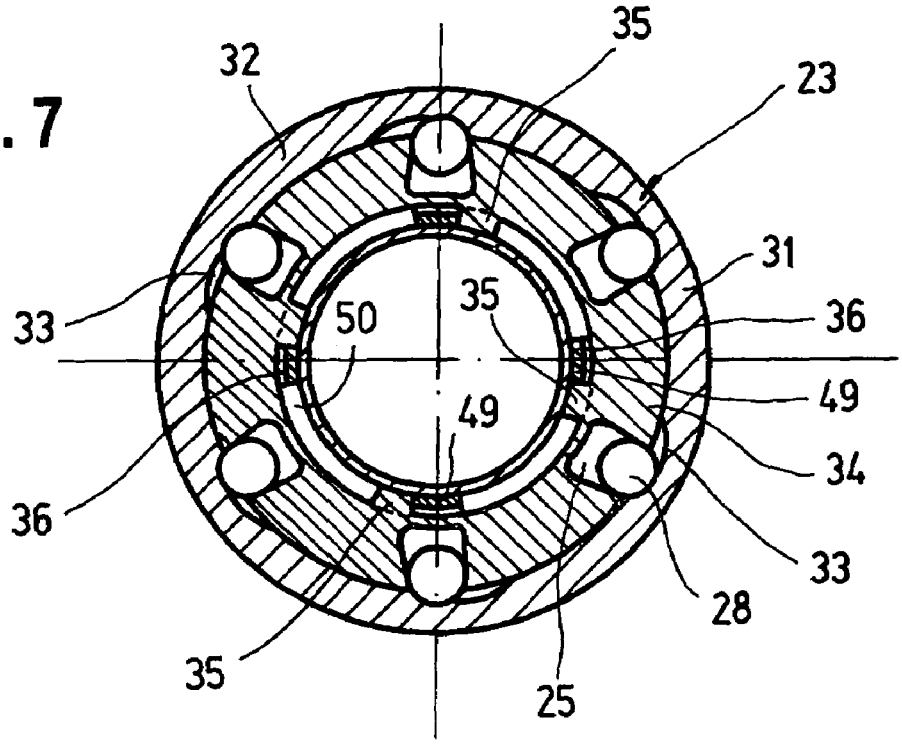
FIG. 7 is a schematic section taken along the line VII- VII in FIG. 6.
Figure 11:
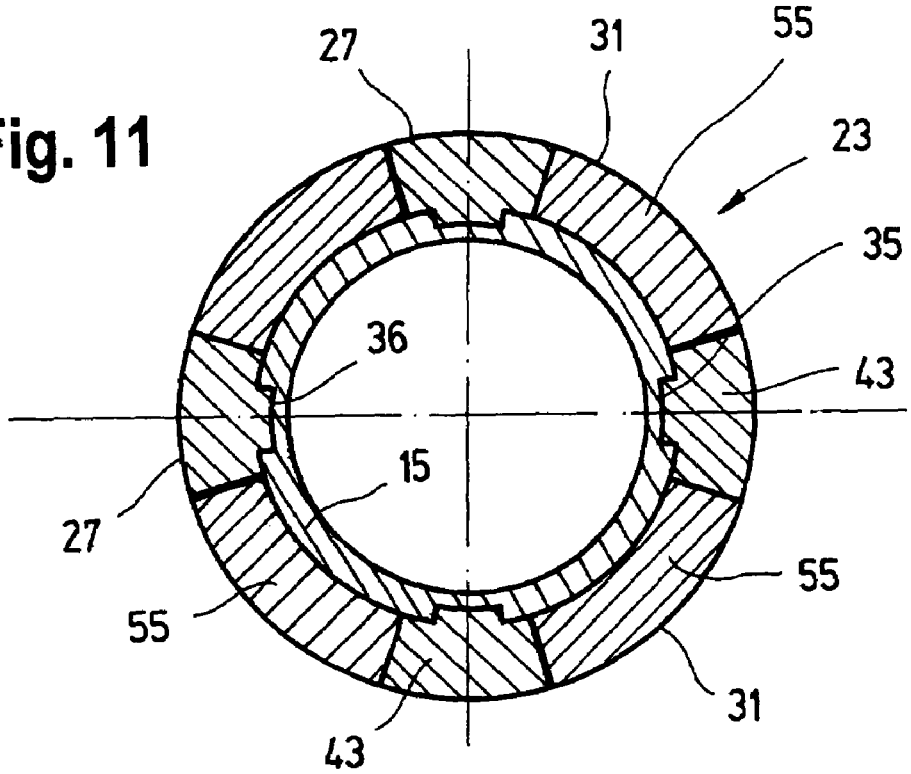
FIG. 11 is a schematic section taken along the line XI-XI in FIG. 10.

In the displacement position of the sliding-key sleeve 46 shown in FIGS. 6 and 7, the slaving cleats 49 extend over the annular groove 50. Via the driven driving gear wheel 14, the transmission elements 28, and the second coupling part 27 in the form of the ring 34, the corresponding rotary motion of this second coupling part is effected. Since its protrusions 35 rest in the circumferential direction on the slaving cleats 49 of the sliding-key sleeve 46, the sliding-key sleeve 46 is driven thereby, and via its slaving cleats 49, the rotary sleeve 15 is likewise driven. This radial-axial principle of the overlock coupling 25, together with the sliding-key sleeve 46, makes the various settings possible, that is, hammer drilling, drilling, vario-lock, and chiseling.

In the fourth exemplary embodiment, shown in FIGS. 10 through 13, the safety coupling 23 is designed essentially in accordance with the second exemplary embodiment of FIGS. 4 and 5, so that in this respect, the same reference numerals are again used for the same parts. In this exemplary embodiment, the first coupling part 26 is not an integral component of the driving gear wheel 14, but instead a separate part 31 from it, which on the axial face end oriented toward the ring 34 has axial toothlike coupling claws 42, which cooperate with the coupling claws 43. This part 31 is embodied as a coupling sleeve 55, which is located axially nondisplaceably on the rotary sleeve 15 between the driving gear wheel 14 and the other coupling part 27 in the form of the ring 34. On the axial face end that is oriented toward the coupling part 27, in particular the ring 34, the coupling sleeve 55 has corresponding axial, toothlike coupling claws 42. The coupling sleeve 55 is supported in the housing 11 by means of the bearing 24 located there and is axially fixed in one direction. For fixation in the other axial direction, a securing ring 56 on the rotary sleeve 15 is employed.

The driving gear wheel 14, the coupling sleeve 55, and the housing 11, in particular the bearing 24, are each provided on the outer circumferential face with a respective axially oriented spline shaft toothing 57, 58, and 59. The spline shaft toothings 57 through 59 are axially aligned with one another. A switching sleeve 60 is seated on this outer circumferential face in the region of the spline shaft toothings 57 through 59 and is axially displaceable by means of an actuating member 61, for instance in the form of a slide sleeve. The actuating member 61 may for instance be actuated analogously to FIGS. 6 through 9 by means of the knob 48 and via a shift rod, not shown, or the like, in order to set whichever mode of operation is desired. The switching sleeve 60, on its edge, has an inner toothing 62, which corresponds to the spline shaft toothings 57 through 59.

Figure 10:
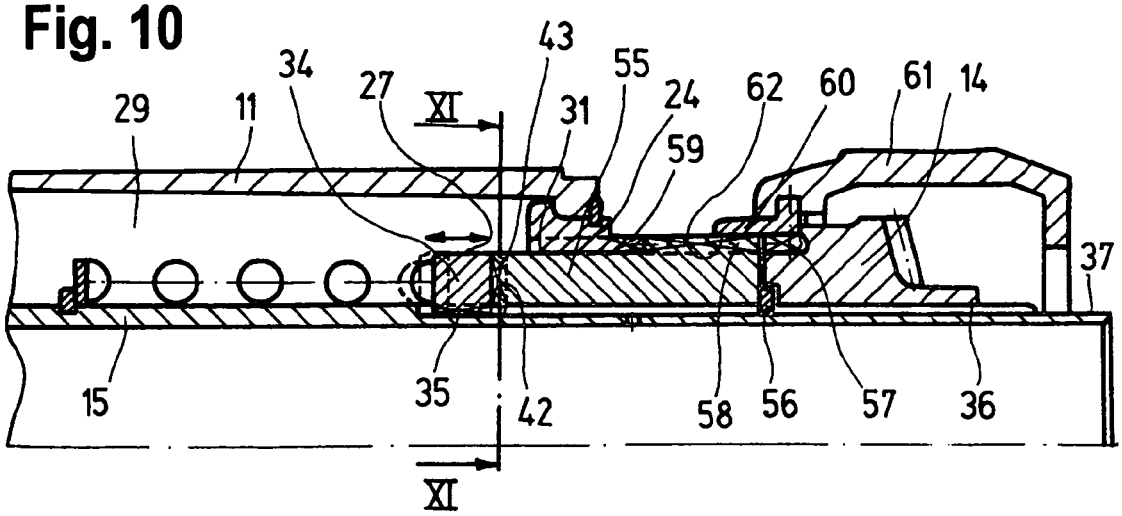
FIG. 10 is a schematic axial longitudinal section of a detail of the hand power tool, in a fourth exemplary embodiment, in a working position.

Depending on the axial displacement position of the switching sleeve 20, its toothing 62 meshes with the spline shaft toothing 57 of the driving gear wheel 14 and the spline shaft toothing 58 of the coupling sleeve 55, as is shown in FIG. 10. In this case, the setting of the hammer drilling/drilling function has been selected. By means of the switching sleeve 60 in this displacement position, the driving motion of the driving gear wheel 14 is transmitted to the coupling sleeve 55 and from it, via the meshing coupling claws 42, 43, to the ring 34, and from it to the rotary sleeve 15 via the protrusions 35 in the longitudinal grooves 36.

Figure 12:
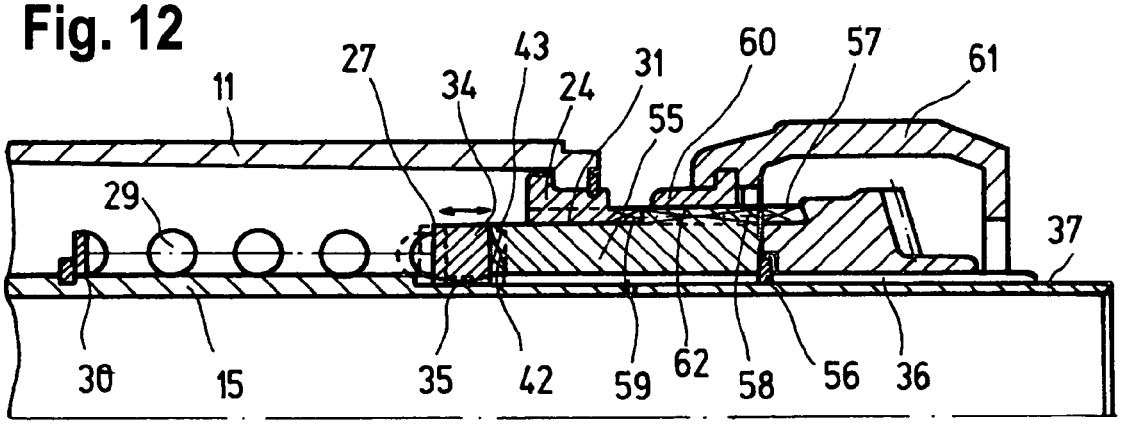
FIGS. 12 and 13 each show a schematic axial longitudinal section of the detail in FIG. 10, in a vario-lock and chiseling position, respectively.
Figure 13:
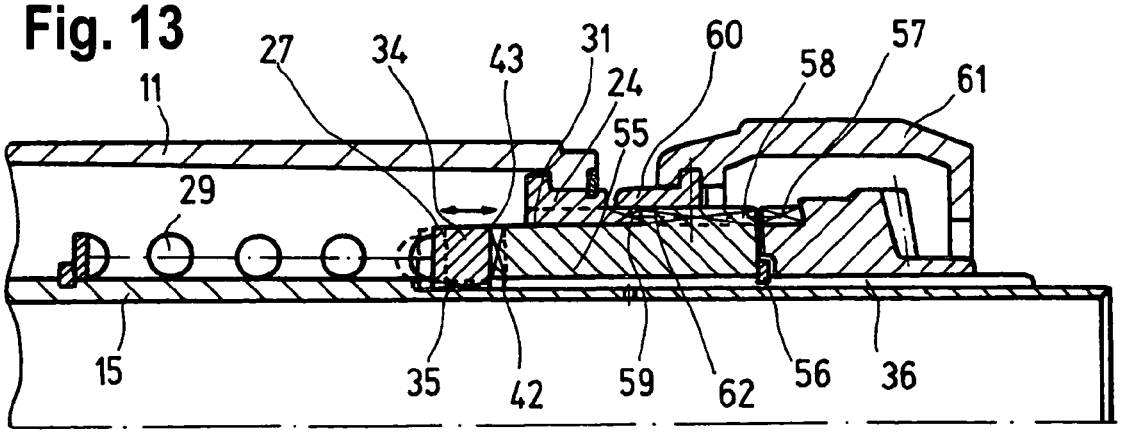

In FIG. 12, a displacement position of the switching sleeve 60 is shown in which its toothing 62 meshes only with the spline shaft toothing 58 of the coupling sleeve 55. The rotational drive of the driving gear wheel 14 is thus transmitted not to the coupling sleeve 55 and not to the rotary sleeve 15, which for adjusting purposes is freely rotatable. In the displacement position of the switching sleeve 60 shown in FIG. 13, its toothing 62 meshes with the spline shaft toothing 58 of the coupling sleeve 55 and simultaneously with the spline shaft toothing 59 of the housing 11, or of the bearing 24. In this position, the coupling sleeve 55 is retained nonrotatably relative to the bearing 24, and as a result, via the meshing coupling claws 42, 43 and the ring 34, the rotary sleeve 15 is arrested. This position is equivalent to the chiseling function.

In this fourth exemplary embodiment as well, the safety coupling 23 functions as explained for instance for the second exemplary embodiment. If in rotational driving the limit torque is exceeded, then the ring 34 deflects axially to the left, counter to the action of the spring 29, so that the coupling sleeve 55, driven by the driving gear wheel 14 via the switching sleeve 60 and the meshing toothings 62, 57 and 58, and the ring 34 are rotatable relative to one another.

For these exemplary embodiments corresponding to FIGS. 4 through 13, the same advantages as were emphasized at the beginning in conjunction with the first exemplary embodiment are again attained.

It will be understood that each of the elements described above, or two or more together, may also find a useful application in other types of constructions differing from the types described above.

While the invention has been illustrated and described as embodied in hand power tool, in particular drill hammer and/or jackhammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand power tool, comprising a housing; drive motor accommodated in said housing; a tool receptacle in which a tool is guided; a gear mechanism, a driving gear wheel, and rotary sleeve arranged so that via said gear mechanism and said driving gear wheel, said rotary sleeve and said tool receptacle are drivable in rotation; a crank drive mechanism and a hammering mechanism located inside said rotary sleeve, so that said tool receptacle is drivable through said crank drive mechanism and said hammering mechanism translationally; and a safety coupling provided between said driving gear wheel and said rotary sleeve and formed so that said safety coupling separates if a limit torque is exceeded, said safety coupling being formed as an overlock coupling seated on said rotary sleeve and having two axially adjacent coupling parts that mesh in a form-locked manner by torque-transmitting transmission elements and are releasable if the limit torque is exceeded counter to an axially acting elastic force, one of said coupling parts being a part associated with said driving gear wheel and rotatable relative to said rotary sleeve while the other of said coupling parts is coupled in a form-locked manner to said rotary sleeve in a way that transmits torque, wherein said one coupling part is formed as a coupling sleeve which is located on said rotary sleeve and relative to this axially nondisplaceably between said driving gear wheel and said other coupling part, said coupling sleeve on an axial face end oriented toward said other coupling part being provided with said torgue-transmitting elements meshing with torgue-transmitting elements of said other coupling part, and further comprising a bearing which supports said coupling sleeve in said housing, wherein said driving gear wheel, said coupling sleeve and said housing on a nonrotatable housing part each have an axially oriented spline shaft toothing on an outer circumferential face, wherein said toothings are aligned axially with one another; and further comprising a switching sleeve provided on said outer circumferential face in a region of said spline shaft toothings, said switching sleeve being axially displaceable by an actuating member and having on an inner circumferential face an inner toothing which corresponds to said spline shaft toothings and is in coupling engagement with said spline shaft toothing of either said driving gear wheel and said coupling sleeve, or only of said coupling sleeve, or of said coupling sleeve and said housing part, depending on an axial displacement position.

2. A hand power tool as defined in claim 1, wherein said drive motor is an electrical drive motor.

3. A hand power tool as defined in claim 1, wherein said one coupling part has one axial face end provided with axial tooth shaped coupling claws.

4. A hand power tool as defined in claim 1, wherein said other coupling part is configured as a ring which is seated on said rotary sleeve and has radially inward oriented protrusions engaging associated longitudinal grooves on a portion of said rotary sleeve in a form-locked manner.

5. A hand power tool as defined in claim 4, wherein said radially inward oriented protrusions are formed as elements selected from the group consisting of lugs and cleats.

6. A hand power tool as defined in claim 4; comprising at least one spring which is located on said rotary sleeve, said at least one spring having one end by which it is braced against said rotary sleeve and the other end by which it is braced on said ring of said other coupling part acting upon said ring with said axially acting elastic force.

7. A hand power tool as defined in claim 4, wherein said ring of said other coupling part on an axial face end oriented towards said one coupling part and its coupling claws, has axial tooth shaped coupling claws corresponding to coupling claws of said one coupling part and meshing with said coupling claws of said one coupling part, said ring of said other coupling part being acted upon by an axially acting elastic force and retained axially displaceably on said rotary sleeve.

8. A hand power tool as defined in claim 1, wherein said bearing is formed as a slide bearing.

9. A hand power tool as defined in claim 1, wherein said nonrotatable housinci part is formed of said bearing that is provided with said axially oriented spline shaft toothing, with which said inner toothing of said switching sleeve is in coupling engagement, depending on the axial displacement position.

* * * * *